United States Patent [19]

Hostler

[11] Patent Number: 4,939,317

[45] Date of Patent: Jul. 3, 1990

[54] POLYIMIDE INSULATED COAXIAL ELECTRIC CABLE

[75] Inventor: John C. Hostler, Flagstaff, Ariz.

[73] Assignee: W. L. Gore & Associates, Inc., Newark, Del.

[21] Appl. No.: 230,632

[22] Filed: Aug. 10, 1988

[51] Int. Cl.[5] ..... H01B 7/18; H01B 9/02

[52] U.S. Cl. ..... 174/107; 428/375; 428/379; 428/380; 428/383; 174/120 SR

[58] Field of Search ..... 428/380, 383, 379, 473.5, 428/474.5, 349; 174/110 N, 120 SR, 121 SR, 107

[56] References Cited

U.S. PATENT DOCUMENTS

| | | | |
|---|---|---|---|
| 3,168,417 | 2/1965 | Smith et al. | 117/213 |
| 3,179,634 | 4/1965 | Edwards | 260/78 |
| 3,352,714 | 11/1967 | Anderson et al. | 117/213 |
| 3,408,453 | 10/1968 | Shelton | 174/68.5 |
| 3,684,646 | 8/1972 | Kreuz et al. | 174/121 SR |
| 4,051,324 | 9/1977 | Anderson et al. | 174/121 SR |
| 4,184,001 | 1/1980 | Hildreth | 428/383 |
| 4,675,246 | 6/1987 | Kundinger et al. | 428/383 X |
| 4,705,720 | 11/1987 | Kundinger et al. | 428/383 X |

FOREIGN PATENT DOCUMENTS

| | | | |
|---|---|---|---|
| 60-40642 | 12/1985 | Japan | 174/107 |

*Primary Examiner*—George F. Lesmes
*Assistant Examiner*—Jill M. Gray
*Attorney, Agent, or Firm*—Gary A. Samuels

[57] ABSTRACT

A high temperature and radiation resistant all polyimide insulated coaxial cable and process of manufacture. Perforated polyimide tape wrapping yields low dielectric constant cable.

10 Claims, 1 Drawing Sheet

POLYIMIDE INSULATED COAXIAL ELECTRIC CABLE

FIELD OF THE INVENTION

The field of the invention is coaxial electric cables which resist high temperature and radiation and at the same time have reduced size and excellent electrical properties.

BACKGROUND OF THE INVENTION

There has been a continuing need for high temperature resistant radiation resistant insulated wire products. One of the best materials for this type of application is polyimide polymer insulation which has the chemical composition to withstand both high temperature and radiation better than most polymeric materials. Typical useful materials are polyimides disclosed and claimed in U.S. Pat. No. 3,129,634 wherein organic aromatic tetravalent acids react with at least one organic divalent benzenoid diamine to give preferably an all aromatic ring structured polyamide-acid intermediate. These intermediates can be made into films or solutions which, after the solvent is removed, can be cured by heating above 50° C. to the fully aromatic polyimide. The polyamide-acid in the form of wire enamel is made by fully curing by baking the polyamide-acids and similar abrasion-resistant baked wire coatings on other insulation and layered with fluorocarbon adhesives as tape wrap wire insulation.

Two problems exist, however, which limit the use of the material in these forms. First, the dielectric constant of the films is high (3.5) as compared to expanded, stretched, or foamed alternative materials (1.3–2.2). Second, where a fluorocarbon thermoplastic adhesive is used in combination with polyimide tape or film, such as disclosed in U.S. Pat. Nos. 3,168,417, 3,352,714 and 3,40B,715, the fluorocarbon is not radiation resistant, and the advantage of radiation resistance is nullified for these tapes. Alternative adhesives which could be substituted, such as polyester, polyurethane, or acrylic, are limited in temperature resistance, however, so that solution is not fully satisfactory.

SUMMARY OF THE INVENTION

To overcome the perceived problems inherent in use of baked polyamide-acid enamels and coatings and fluorocarbon adhesive-backed polyimide tapes, liquid polyamide-acid adhesives are coated as adhesive layers or coatings onto perforated fully cured polyimide tapes. A metal center conductor is wrapped with such a polyamide-acid coated polyimide tape by standard cable making machinery to the desired thickness, and the tape-wrapped wire passed through an oven above 50° C. for a time sufficient to fully convert the polyamide-acid to polyimide. This cured construction is now wrapped with polyamide-acid adhesive coated polyimide binder tape to bind and seal the porous insulation covering the wire and this binder or sealing layer also cured above 50° C. in like manner to the previous polyamide-acid layer.

The bound cable is now shielded by a layer of conductive shielding by a method known in the cabling art which may be metal wire braiding, braided metal foil, served metal tape, or metallized polyimide tape, which has an adhesive coating of polyamide-acid. The latter tape, if used, is cured as described above.

The shielded cable is now completed by dipping one or more times in a liquid coating of the polyamide-acid adhesive solution, which is dried between coats, to build up a protective jacket of desired thickness, which is cured by baking above 50° C. as above or as many layers as needed of polyamide-acid adhesive coated polyimide tape is wrapped around the cable to give a suitable protective jacket when it has been fully cured above 50° C. for an adequate period of time. A combination tape and dip-coated jacket may be used alternatively.

A final cable product where 50% of the area of the first layer of the tape has been removed by punching out small holes evenly across the area so that 50% of the polyimide is replaced by air will have a dielectric constant of about 1.8 versus 3.5 for an equal thickness of solid polyimide. The percent air content can be varied somewhat by changing perforation hole size, numbers, and spacing to taylor the material for particular applications.

DESCRIPTION OF THE PREFERRED EMBODIMENTS

Figure 1:
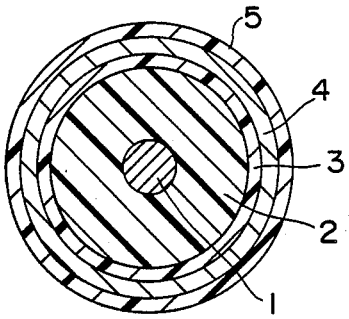
FIG. 1 is a cross-section of a cable of the invention.
Figure 2:
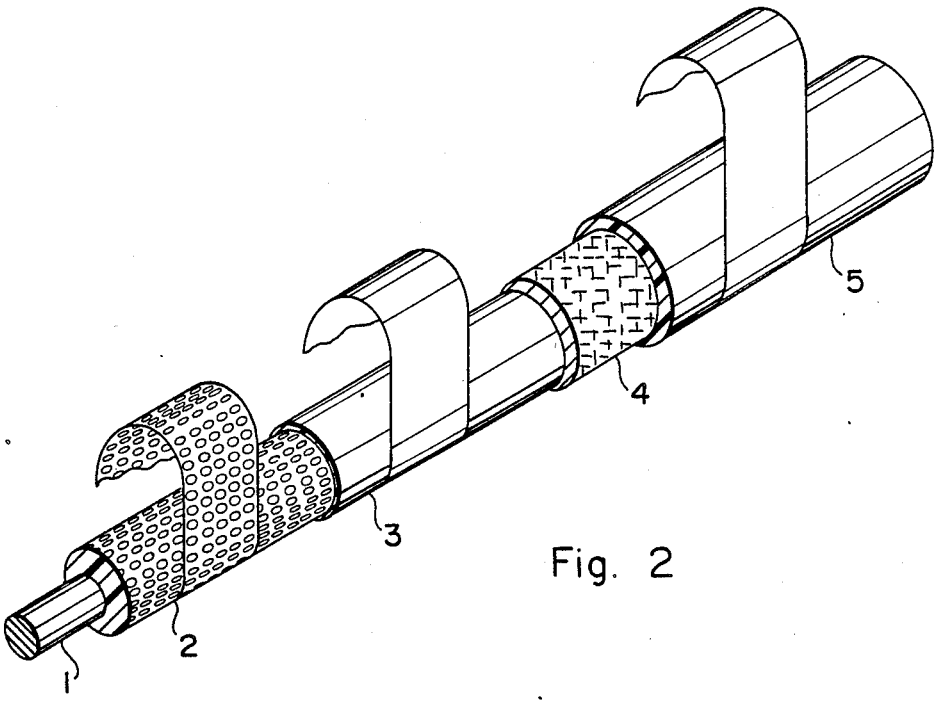
FIG. 2 is a perspective of a cable with the several layers peeled back in sequence to show their relationship to each other.

With reference to the figures, a detailed description of the invention is now made including the processes used for making the cables. FIG. 1 is a cross-section of a cured polyimide cable of the invention wherein the conductive metal center conductor 1 is surrounded by porous polyimide insulation 2. Insulation 2 has been formed about conductor 1 by wrapping conductor 1 with a perforated polyimide tape which has coated on it a thin layer of polyamide-acid adhesive, which has been applied from a solution of the amide-acid in a solvent, much as one of those listed in U.S. Pat. No. 3,179,634 above, examples of which are dimethylformamide and dimethylacetamide. When the desired thickness of insulation 2 has been achieved, a binder tape 3 of solid polyimide tape coated with the same or similar polyamide-acid adhesive as used on the perforated tape is wrapped around insulation 2 to bind it in place and to seal the porosity into the cable.

At this point in the process, the cable is heated above 50° C. for a period long enough to completely convert any polyamide-acid present to polyimide, the amide-acid groups present splitting out water to leave an imide group in a newly closed aromatic ring. This adds greatly to product stability and improves physical properties.

The all-polyimide insulated cable is now shielded by a conductive shielding 4 by one of the methods known in the art for shielding electrical cables or forming coaxial electric cables, such as wrapping the cable with a served conductive metal foil or a metallized polyimide polymer tape or braiding a conductive wire or tape shield about the cable by an art known braiding means or mechanism.

The shielded cable is wrapped with a protective layer 5 of polyamide-acid adhesive coated tape which is heated above 50° C. for a sufficient period of time to effect complete conversion of the adhesive to polyimide or the cable is dipped, spray coated, or otherwise coated with polyamide-acid in solvent to build up a selected thickness of coating and heated similarly above 50° C. to convert this coating completely to polyimide.

The process yields a small light weight, radiation-resistant, all-polyimide insulated and coated cable of improved electrical performance such as increased velocity of propagation and reduced capacitance. The cable will also have a dielectric constant of about 1.8–1.9 if about 50% of the volume of polyimide is punched out of the tape forming the main insulation of the cable to be replaced by air. Solid polyimide has a dielectric constant of about 3.5. The sealing and air retention in the insulation is equivalent to that typical for use of standard processes.

The polyimide tape is hole-punched or perforated by a combination male/female punch roll system which allows continuous longitudinal perforation of the film. This method is preferred if the tape is to be used subsequently for tape wrapping. Long lengths yield maximum productivity and minimum costs and the method is a standard in the industry for films and foils.

Alternative to heating above 50° C. for a period of time to convert the polyamide-acid to polyimide, the amide-acid can be heated or dehydrated chemically in acetic anhydride and pyridine at 200°–250° C. It has also been found that if the amide-acid has been converted to polyimide at less than 300° C., the thermal and hydrolytic stability properties of the polyimide may be improved by heating between 250° and 500° C. for 15 seconds to 2 hours.

The cable is expected to find utility in nuclear power plants and around other radiation sources, military nuclear power applications, satellite and space vehicle or station exposed or lightly shielded wiring, and high temperature applications where polyimide would be used but reduced size is important, and other uses such as the above for digital signal application requiring resistance to heat and/or radiation.

While the invention has been disclosed in terms of certain embodiments and detailed descriptions, it will be clear to one skilled in the art that modifications or variations of such details may be made without deviating from the scope of the invention, which is limited only by the claims appended below.

I claim:

1. A coaxial electrical cable comprising in order:
(a) a conductive metal center conductor surrounded by;
(b) a first layer of a polyimide adhesive-coated perforated polyimide insulative tape surrounding said conductor;
(c) a second layer of polyimide adhesive-coated solid polyimide insulative binding tape surrounding said first layer;
(d) a conductive shield surrounding said second layer; and
(e) a polyimide outer coating surrounding said shield.

2. A cable of claim 1, wherein said perforated tape is about 20 percent to about 80 percent perforated.

3. A cable of claim 2, wherein said perforated polyimide tape is at least 50% perforated.

4. A cable of claim 1, wherein the conductive shield is selected from the group consisting of metallized polyimide tape, metal foil, braided wire, or braided metal foil strips.

5. A cable of claim 1, wherein the polyimide outer coating is a polyimide adhesive-coated wrapped film.

6. A cable of claim 1, wherein the polyimide outer coating is cured polyimide adhesive.

7. A process for manufacturing a polyimide coaxial cable comprising the steps of:
(a) wrapping a conductive metal center conductor with a polyamide-acid adhesive coated perforated polyimide tape;
(b) wrapping the tape wrapped conductive of (a) with a polyamide-acid adhesive coated polyimide binding tape;
(c) enclosing the bound wrapped conductor with a conductive shield;
(d) applying a polyamide-acid adhesive containing outer coating to the shielded bound wrapped conductor; and
(e) heating the polyamide-acid adhesive coating above 50° C. for a time sufficient to convert them to the insoluable polyimide.

8. A process of claim 7, including wrapping said shield with a coating of polyamide-acid adhesive coated polyimide tape.

9. A process of claim 8, including enclosing said shield with a polyimide coating by dipping or coating a polyamide-acid adhesive in a solvent onto the cable then removing said solvent.

10. A coaxial electric cable comprising in order:
(a) a conductive metal center conductor surrounded by;
(b) a first layer of polyamide-acid adhesive coated perforated polyimide insulative tape surrounding said conductor;
(c) a second layer of polyamide-acid adhesive coated solid polyimide insulative binding tape surrounding said first layer;
(d) a conductive shielding surrounding said second layer; and
(e) a polyamide-acid containing polyimide outer coating surrounding said shield.

* * * * *